US011298812B1

(12) United States Patent
Price

(10) Patent No.: US 11,298,812 B1
(45) Date of Patent: Apr. 12, 2022

(54) PORTABLE TABLE ASSEMBLY

(71) Applicant: Adam Price, Springfield, OH (US)

(72) Inventor: Adam Price, Springfield, OH (US)

( * ) Notice: Subject to any disclaimer, the term of this patent is extended or adjusted under 35 U.S.C. 154(b) by 17 days.

(21) Appl. No.: 16/986,084

(22) Filed: Aug. 5, 2020

(51) Int. Cl.

| | |
|---|---|
| ***B25H 1/04*** | (2006.01) |
| ***B25H 1/06*** | (2006.01) |
| ***A47B 3/12*** | (2006.01) |
| ***A47B 13/00*** | (2006.01) |
| ***A47B 3/06*** | (2006.01) |

(52) U.S. Cl.
CPC ..... *B25H 1/04* (2013.01); *A47B 3/06* (2013.01); *A47B 3/12* (2013.01); *A47B 13/003* (2013.01); *B25H 1/06* (2013.01); *A47B 2200/002* (2013.01)

(58) Field of Classification Search
CPC ... B25H 1/04; B25H 1/06; B25H 1/02; B25H 1/14; B25H 1/08; A47B 3/06; A47B 3/12; A47B 13/003; A47B 13/04; A47B 13/088; A47B 2200/002; Y10T 403/46; Y10T 403/4602; Y10T 403/4608; Y10T 403/4631; F16M 13/00
USPC .... 108/157.1, 153.1, 154, 155, 157.16, 159, 108/158.13, 158, 156, 163, 65, 67, 90; 182/181.1; 144/286.1, 386.5; 269/290, 269/296, 329
See application file for complete search history.

(56) References Cited

U.S. PATENT DOCUMENTS

| | | | | |
|---|---|---|---|---|
| 2,891,819 | A * | 6/1959 | Jackson | E04G 1/28 182/113 |
| 2,897,912 | A * | 8/1959 | Tucker | B25H 1/06 182/226 |
| 3,126,188 | A * | 3/1964 | Dieas | A47B 37/00 248/188 |
| 3,604,370 | A * | 9/1971 | Sherwood | A47B 3/12 108/153.1 |
| 3,631,941 | A | 1/1972 | Greenman et al. | |
| 4,241,808 | A * | 12/1980 | Middleton | B25H 1/06 182/155 |
| 4,502,565 | A * | 3/1985 | Koffski | B25H 1/06 182/182.4 |
| 4,512,131 | A * | 4/1985 | Laramore | E04B 1/10 52/586.1 |
| 8,997,930 | B2 * | 4/2015 | Moss | E04G 1/30 182/129 |
| 10,221,625 | B1 * | 3/2019 | Bernhard, Jr | E06C 7/14 |
| 2005/0199443 | A1 * | 9/2005 | Slavich | B25H 1/04 182/153 |
| 2005/0258002 | A1 * | 11/2005 | Sabo | E06C 7/14 182/129 |

(Continued)

FOREIGN PATENT DOCUMENTS

| | | | |
|---|---|---|---|
| CA | 2748513 | * | 2/2012 |
| FR | 2828426 | * | 2/2003 |

*Primary Examiner* — Janet M Wilkens

(74) *Attorney, Agent, or Firm* — AdamsIP, LLC; Stephen Thompson; James Hunter Adams

(57) ABSTRACT

A portable table assembly and a method of assembling a portable table are provided. The table includes individual planks that laterally interlock with each other to form a tabletop and leg assemblies for supporting the tabletop. The leg assemblies each have a crossbeam and opposing clamps at each end of the crossbeam. The planks are arranged perpendicularly to the crossbeams, and planks on the ends of the tabletop are securely retained against the crossbeams. The table breaks down into individual planks and leg assemblies for transport and storage.

18 Claims, 7 Drawing Sheets

(56) References Cited

U.S. PATENT DOCUMENTS

| | | | | |
|---|---|---|---|---|
| 2008/0006186 | A1* | 1/2008 | Stalemark | E04F 15/02044 108/153.1 |
| 2011/0056768 | A1 | 3/2011 | Budreau | |
| 2011/0271877 | A1* | 11/2011 | Frisina | A47B 96/18 108/42 |
| 2012/0036705 | A1* | 2/2012 | Gehris | B25H 1/02 29/559 |
| 2012/0169001 | A1* | 7/2012 | Ducek | B27B 5/26 269/290 |
| 2016/0150875 | A1* | 6/2016 | Sobkow | A47B 29/00 108/65 |
| 2017/0173778 | A1* | 6/2017 | Reinhart | B25H 1/14 |
| 2017/0252917 | A1* | 9/2017 | Williams | B25H 1/08 |

* cited by examiner

PORTABLE TABLE ASSEMBLY

FIELD OF THE INVENTION

The present invention relates generally to a portable table assembly and a method of assembling a portable table.

BACKGROUND

A variety of portable tables are used for setting up tables and then storing the tables when not in use. Such portable tables typically have legs that fold under the tabletop or collapsible leg assemblies that detach from the tabletop. These features generally make the table easier to transport and to store when the table is not being used. However, such portable tables are often still not sufficiently compact and are thus difficult to transport and store, particularly for a single individual handling the table, due to the relatively large size of a typical tabletop. In cases in which the leg assembly detaches from the tabletop, the brackets or other mechanisms for securing the tabletop may be difficult and cumbersome to operate. In some instances, the tabletop may simply rest on top of one or more leg assemblies, such as a work table made by placing plywood across two sawhorses, but such a configuration may result in an unsteady tabletop that shifts position when using the table, which may present a safety hazard when using such a work table as a platform for power tools.

Thus, existing portable tables have a number of disadvantages which may exist separately or in combination.

Accordingly, a need exists in the art for a portable table assembly that provides a stable tabletop and that is sufficiently compact for a single user to easily transport and store the table assembly when disassembled, as well as a method of assembling the portable table for use in any desired location.

SUMMARY

In one aspect, a portable table assembly and a method of assembling a portable table are provided. The table comprises a plurality of planks that interlock along a lateral side of each plank to form a tabletop. The portable table further comprises a leg assembly to which the tabletop is removably secured by opposing clamps that retain opposing end planks of the tabletop in a fixed position relative to the leg assembly. The leg assembly comprises a crossbeam connected to legs, which are preferably foldable against an underside of the crossbeam. The table preferably comprises two leg assemblies to which the tabletop is secured and that support the tabletop when the table is set up for use. The portable table may be disassembled by releasing the tabletop from the leg assemblies and separating the individual planks from each other. The legs of each leg assembly may also be folded to minimize the size of the leg assemblies. The planks and leg assemblies may then be stored or placed within a bag, case, or other type of container for transport or storage. Because the tabletop is formed from a plurality of separate planks, none of the individual components of the portable table are bulky or difficult to handle.

Each plank has two opposing lateral sides that each has a profiled surface shaped to interlock with the profiled surface of an adjacent plank. In a preferred embodiment, the profiled surface of one lateral side of each plank defines a male member, and the profiled surface of the opposing lateral side of each plank defines a female member. The male and female members extend laterally along the entire length of each side of each plank so that each plank has a uniform cross-sectional shape. The male and female members are sized and shaped to interlock with each other so that a plurality of planks may be laterally interlocked to form the tabletop. In a preferred embodiment, the tabletop spans six planks across. The crossbeam has two opposing ends, and a clamp is disposed at each end. Each of the opposing clamps is configured to mate with the profiled surface of one respective end plank of the tabletop to fixedly secure the end plank against the crossbeam. Thus, once assembled, the opposing end planks are secured to the leg assemblies, and all planks, including the two end planks and all planks between the end planks, are laterally interlocked with adjacent planks.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components. The term "removably secured" and grammatical equivalents thereof are used herein to mean the joining of two components in a manner such that the two components are secured together, but may be detached from one another and re-secured together without requiring the use of specialized tools and without causing damage to either component.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
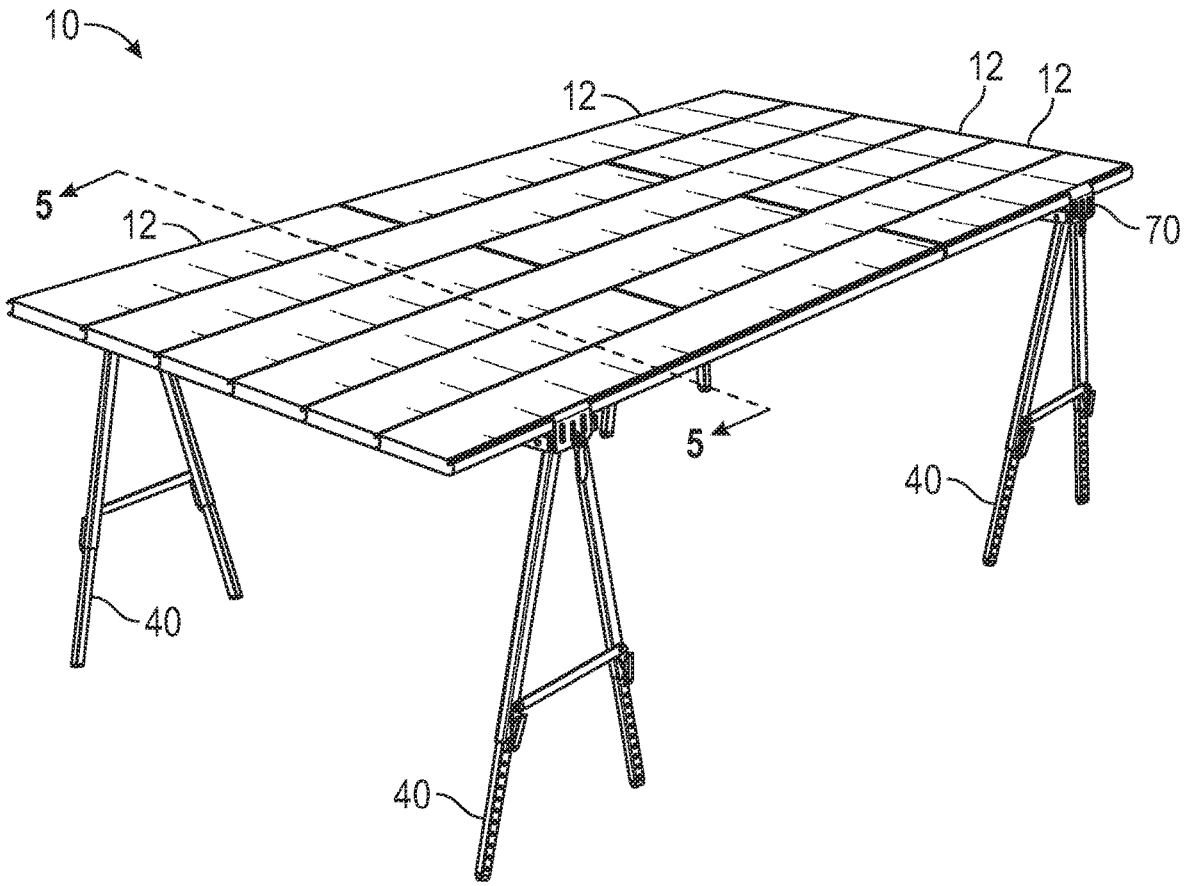
FIG. 1 shows a perspective view of a portable table in accordance with the present disclosure.
Figure 2A:
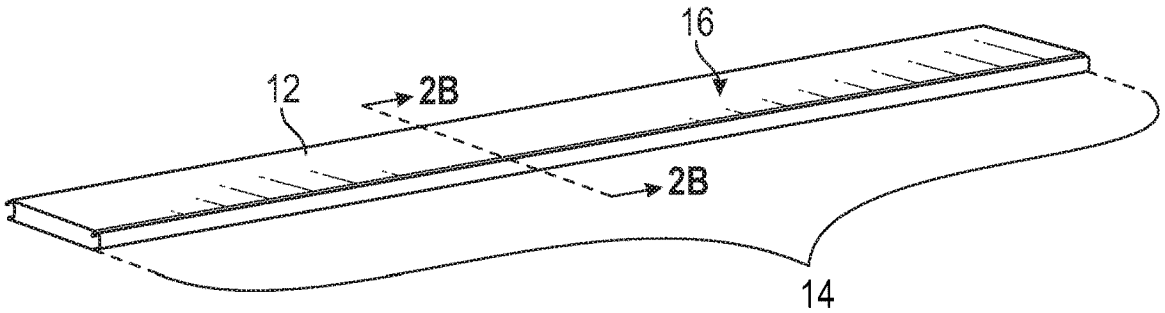
FIG. 2A shows a perspective view of a plank used in assembling a portable table in accordance with the present disclosure.
Figure 2B:
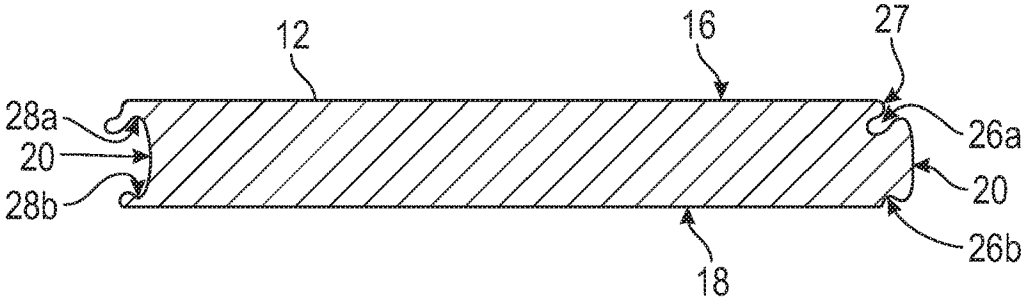
FIG. 2B shows a cross-sectional view of the plank shown in FIG. 2A.
Figure 2C:
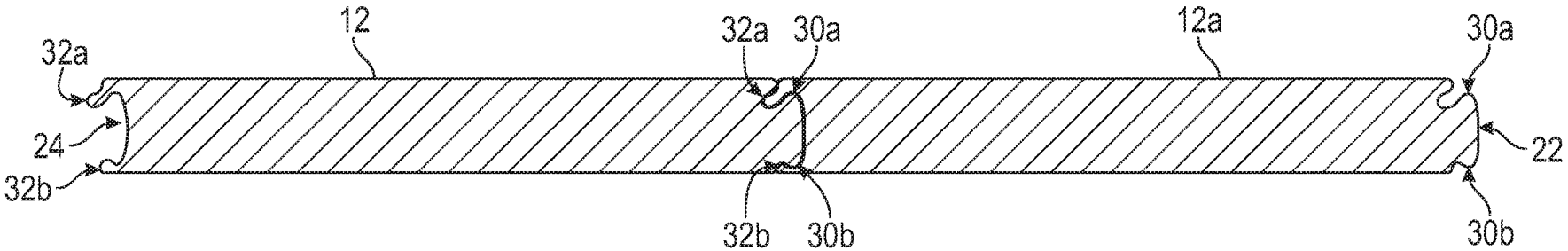
FIG. 2C shows a cross-sectional view of two planks interlocked with each other in accordance with the present disclosure.
Figure 3:
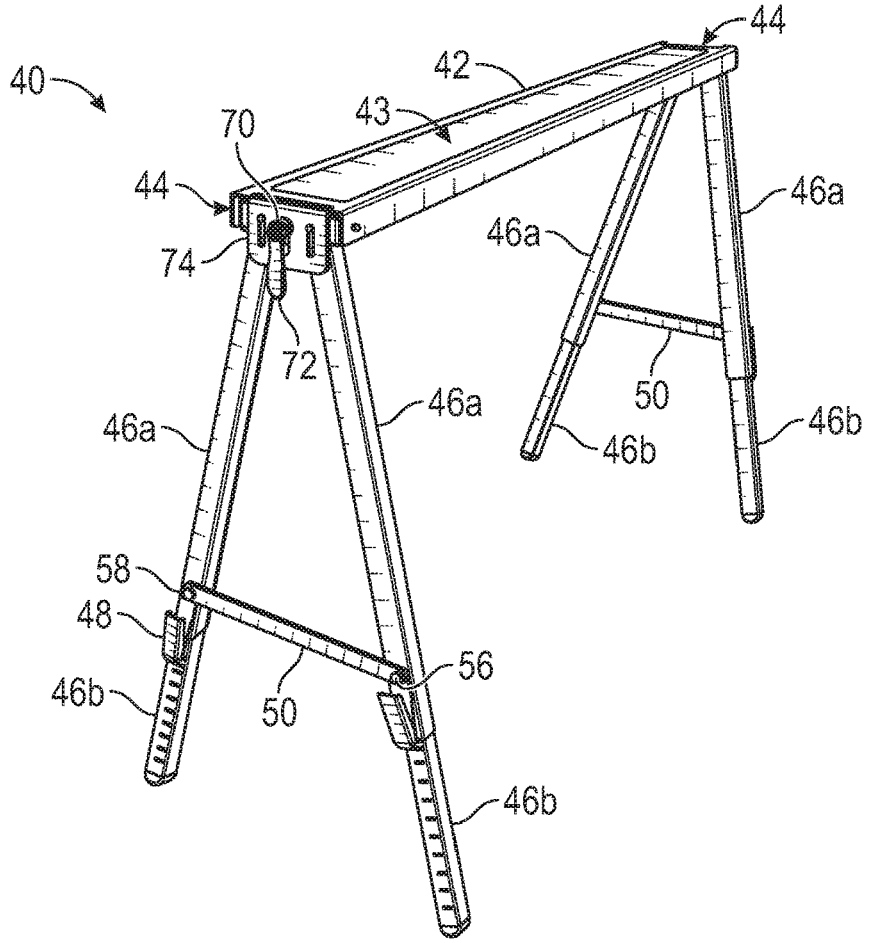
FIG. 3 shows a perspective view of a leg assembly used in assembling a portable table in accordance with the present disclosure.
Figure 4:
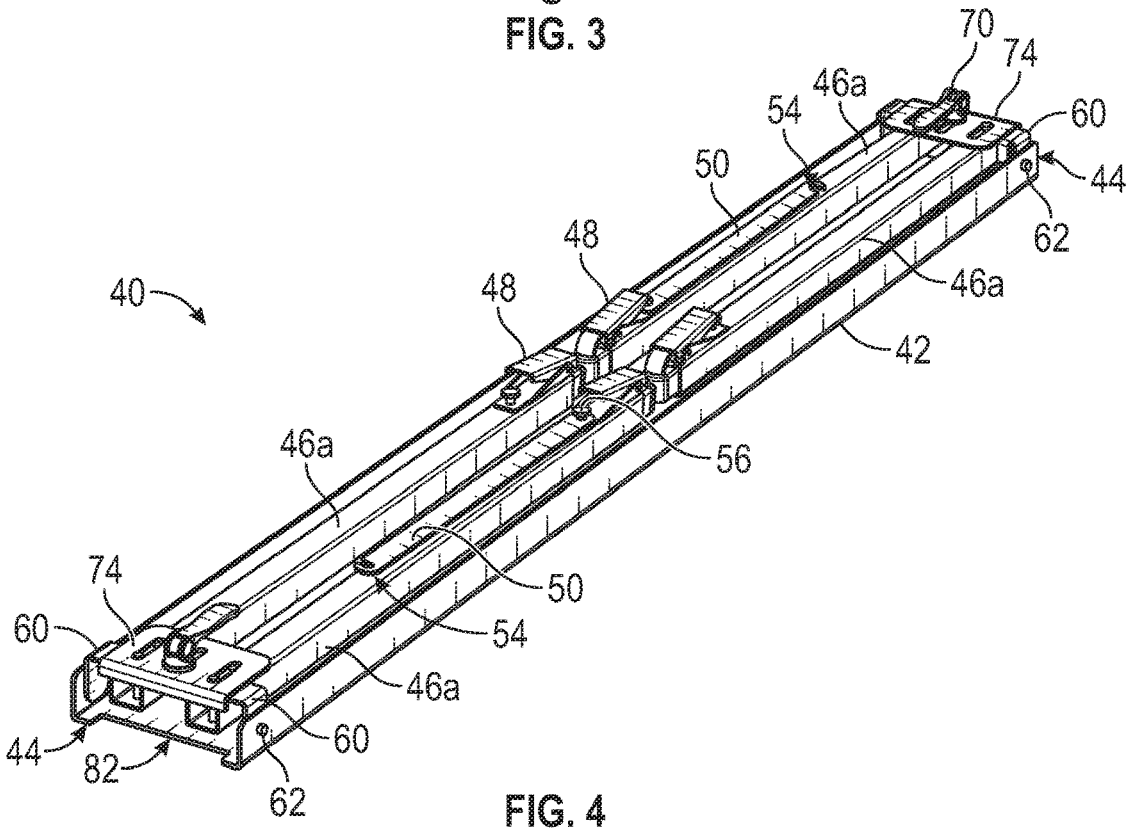
FIG. 4 shows a perspective view of the leg assembly shown in FIG. 3 in a collapsed configuration in accordance with the present disclosure.
Figure 5:
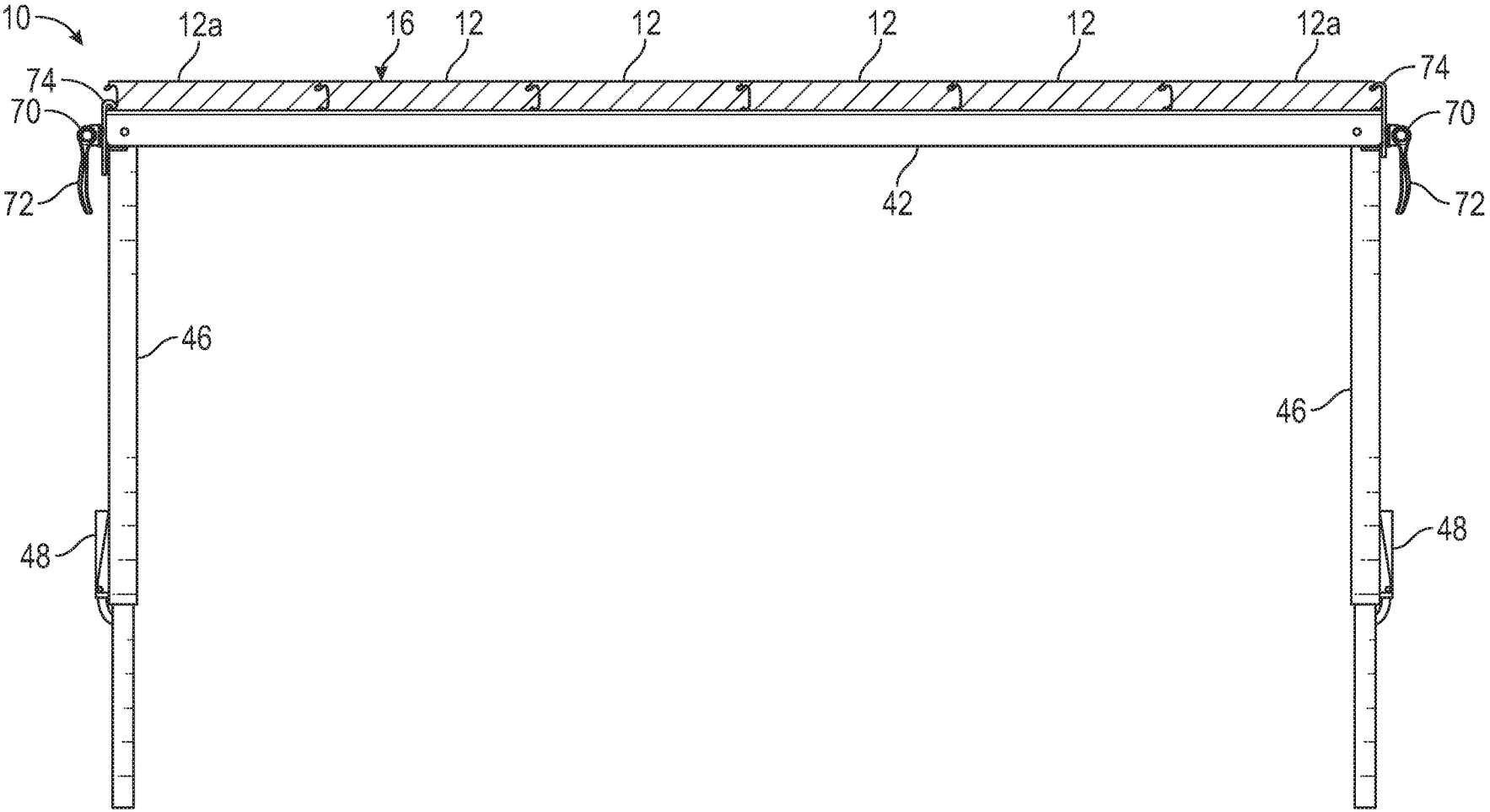
FIG. 5 shows a cross-sectional view of the portable table shown in FIG. 1.
Figure 6A:
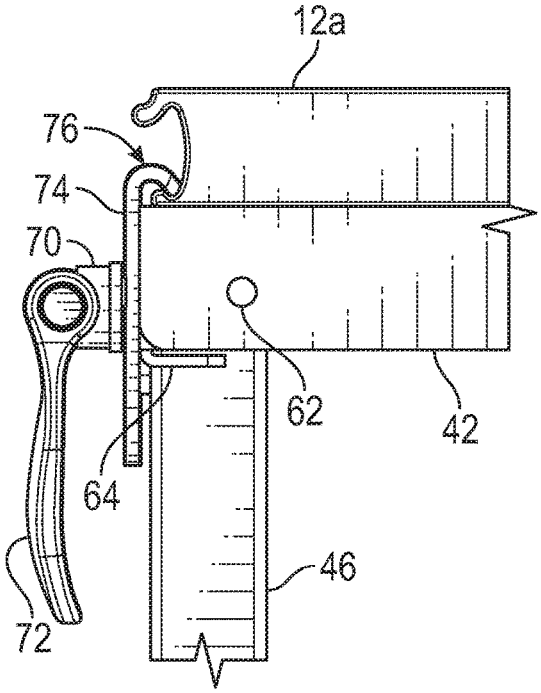
FIG. 6A shows a partial elevational view of a leg assembly and an end plank of a tabletop with a clamp being used to secure the end plank to the leg assembly in accordance with the present disclosure.
Figure 6B:
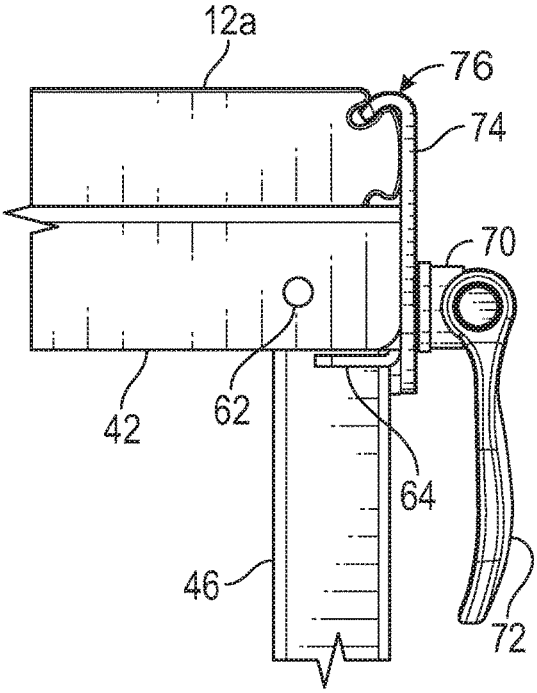
FIG. 6B shows a partial elevational view of a leg assembly and an end plank of a tabletop with a clamp being used to secure the end plank to the leg assembly in accordance with the present disclosure.
Figure 6C:
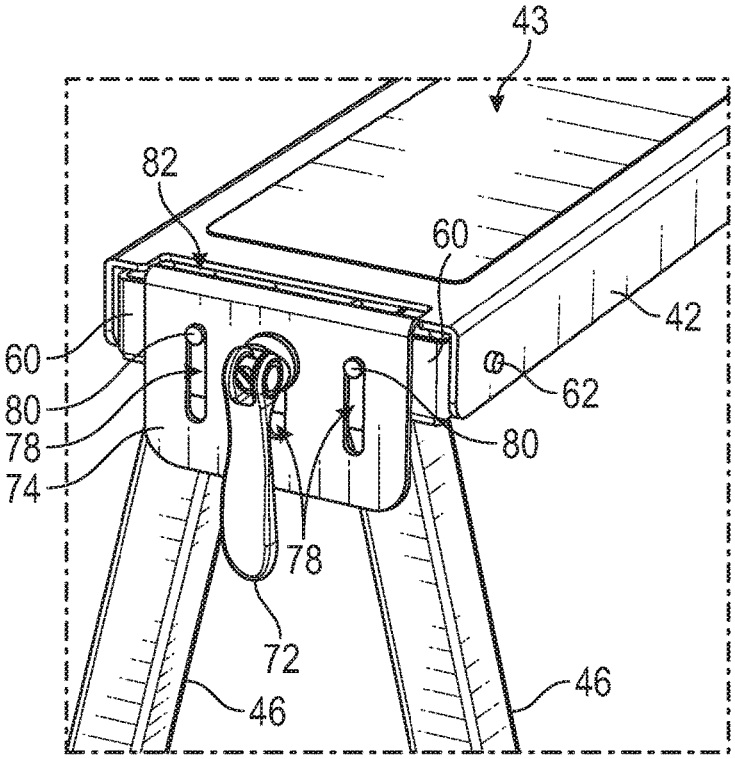
FIG. 6C shows a partial perspective view of a leg assembly with a clamp for securing an end plank to the leg assembly in accordance with the present disclosure.
Figure 6D:
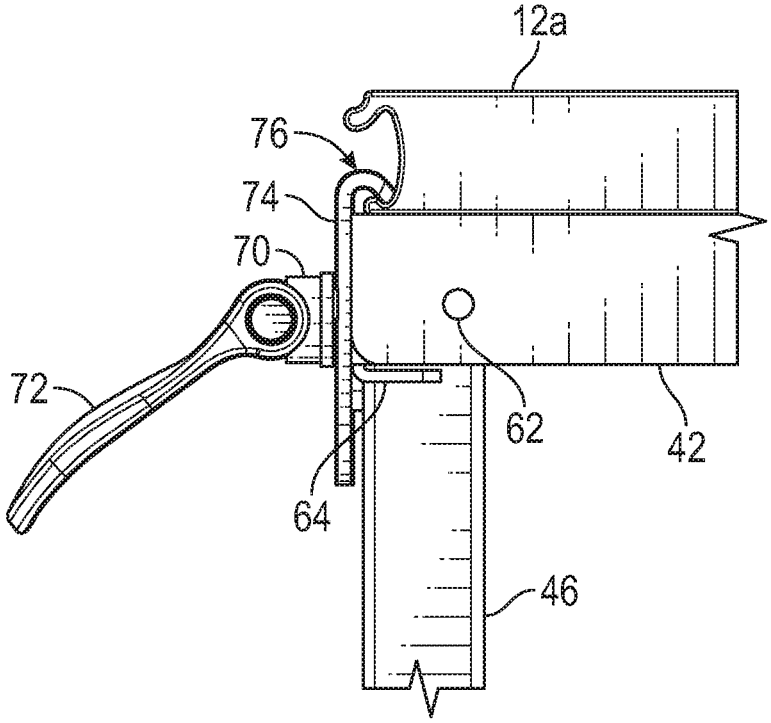
FIG. 6D shows a partial elevational view of a leg assembly and an end plank of a tabletop with a clamp for securing the end plank to the leg assembly in accordance with the present disclosure.
Figure 6E:
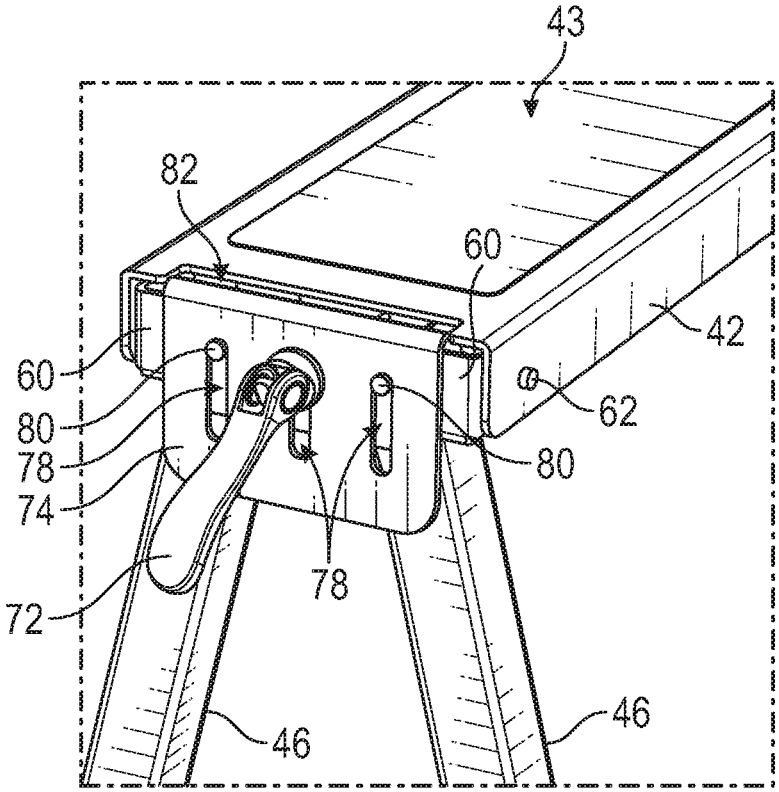
FIG. 6E shows a partial perspective view of a leg assembly with a clamp for securing an end plank to the leg assembly in accordance with the present disclosure.
Figure 7:
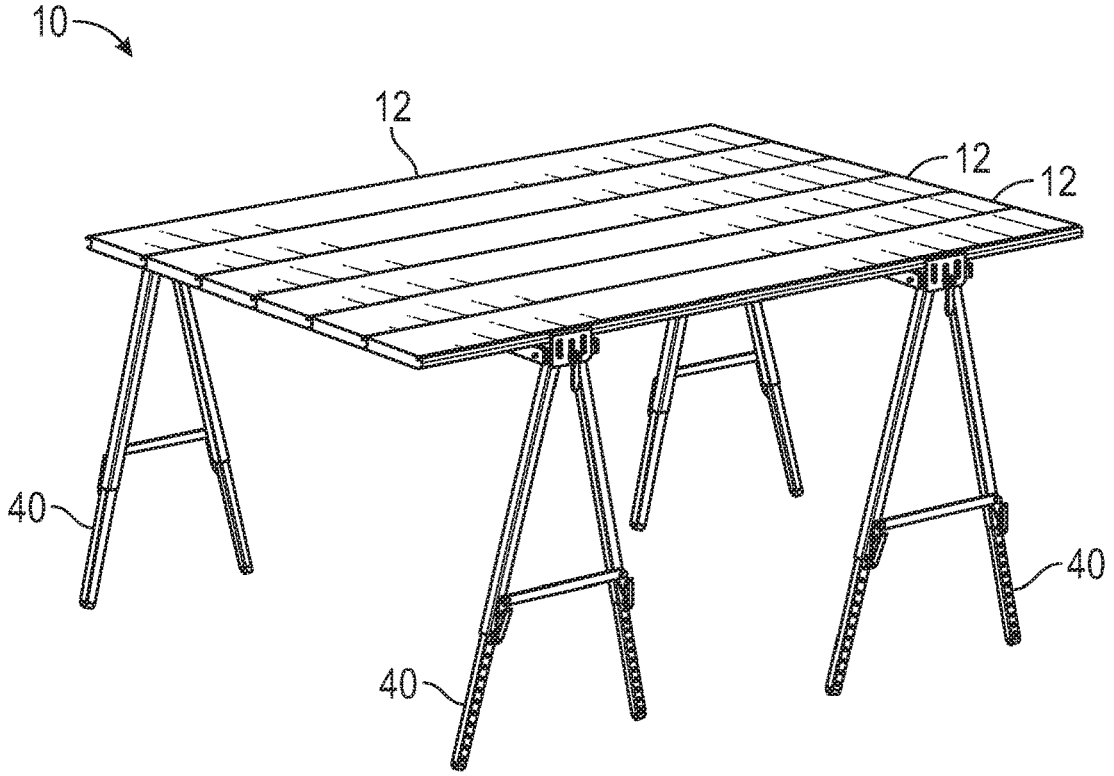
FIG. 7 shows a perspective view of a portable table in accordance with the present disclosure.
Figure 8:
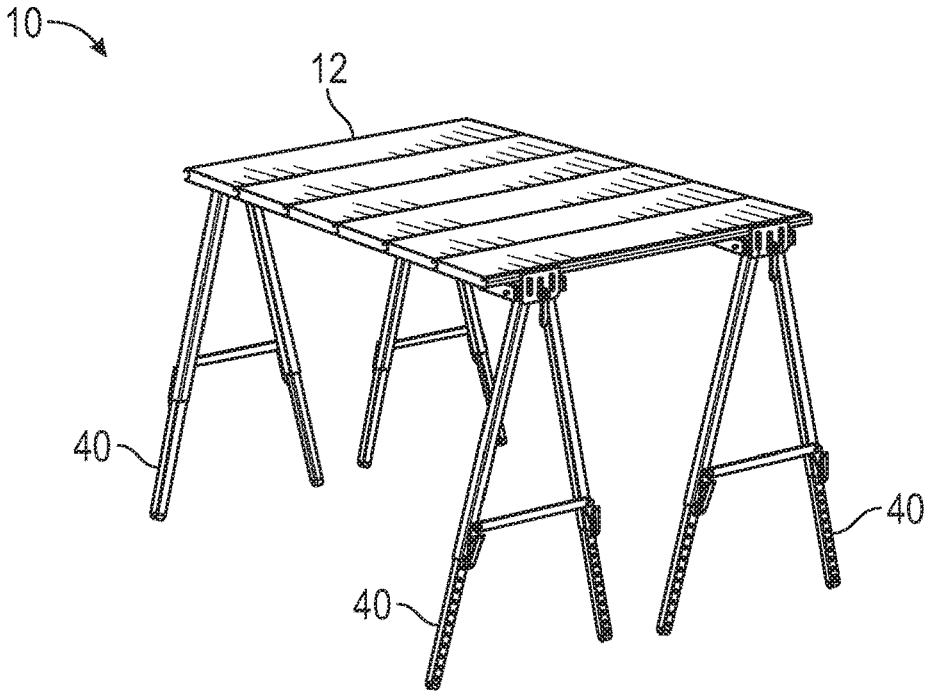
FIG. 8 shows a perspective view of a portable table in accordance with the present disclosure.

A portable table assembly and a method of assembling a portable table 10 are provided. FIGS. 1-8 illustrate preferred embodiments of the present table 10. The table 10 comprises a plurality of interlocking planks 12 that interlock along a lateral side 14 of each plank 12 to form a tabletop. FIGS. 2A and 2B illustrate a preferred embodiment of an individual plank 12 that may be utilized to assemble the present table 10. Each plank 12 has a top side 16 and a bottom side 18. Once assembled, the top sides 16 of the plurality of planks 12 collectively define the tabletop, which includes two opposing end planks 12*a*, as best seen in FIG. 5. As shown in FIGS. 2A and 2B, each plank 12 has two opposing lateral sides 14 that each has a profiled surface 20 shaped to interlock with the profiled surface 20 of an adjacent plank 12, as shown in FIG. 2C. The lateral side 14 of each plank 12 extends lengthwise along the entire length of each opposing side of each of the elongated planks 12. In a preferred embodiment, the profiled surface 20 of one lateral side 14 of each plank 12 defines a male member 22, and the profiled surface 20 of the opposing lateral side 14 of each plank 12 defines a female member 24, as illustrated in FIG. 2C. The male and female members 22 and 24 extend laterally and continuously along the entire length of each lateral side 14 of each plank 12 so that each plank 12 has a uniform cross-sectional shape, as shown in FIG. 2B. The male and female members 22 and 24 are sized and shaped to interlock with each other so that a plurality of planks 12 may be laterally interlocked to form the tabletop, as best seen in FIG. 5. As shown in FIG. 2C, the shapes of the corresponding male and female profiled surfaces 20 preferably conform to each other and interlock so that the top side 16 and bottom side 18 of adjacent interlocked planks 12 are flush with each other. In a preferred embodiment, as shown in FIGS. 1, 7, and 8, the tabletop spans six planks across with two end planks 12*a* and four interior planks 12. When two planks 12 are interlocked with each other, the planks 12 cannot be separated from each other by pulling the two planks 12 away from each other in opposite directions. In addition, if one plank 12 is lifted while in the horizontal position, as shown in FIG. 2C, the other interlocked plank 12 will remain laterally interlocked with and in the same relative position to the lifted plank 12.

In a preferred embodiment, as best seen in FIG. 2B, both the male member 22 and the opposing female member 24 of each plank 12 are not symmetrical. The male member 22 preferably has two opposing protuberances 30*a* and 30*b* on an upper end and a lower end of the male member 22, respectively, as illustrated in FIG. 2C. The upwardly and downwardly extending protuberances 30 define two opposing grooves 26*a* and 26*b* on a top side and on a bottom side of the male member 22, respectively. The female member 24 is preferably defined by two opposing protuberances 32*a* and 32*b* on an upper end and on a lower end of the female member 24, respectively, as shown in FIG. 2C. The upwardly and downwardly extending protuberances 32 of the female member 24 define two opposing grooves 28*a* and 28*b* on a top side and on a bottom side, respectively, of the female member 24. The protuberances 30, 32 and grooves 26, 28 extend lengthwise continuously along the entire lateral side 14 of each plank 12. The profiled surfaces 20 of the male and female members 22 and 24 are shaped so that the protuberances 30, 32 fit within the grooves 26, 28 to interlock adjacent planks 12, as shown in FIG. 2C. Thus, the upper protuberance 30*a* of the male member 22 fits within the top groove 28*a* of the female member 24, and the lower protuberance 30*b* of the male member 22 fits within the bottom groove 28*b* of the female member 24. Similarly, the upper protuberance 32*a* of the female member 24 fits within the top groove 26*a* of the male member 22, and the lower protuberance 32*b* of the female member 24 fits within the bottom groove 26*b* of the male member 22.

In a preferred embodiment, as best seen in FIGS. 2B and 2C, the protuberance 32*a* at the upper end of the female member 24 extends laterally outward farther than the protuberance 32*b* at the lower end of the female member 24. The upper protuberance 32*a* may also extend inward transversely between the top side 16 and the bottom side 18 of the plank 12 farther than the lower protuberance 32*b*. Similarly, to conform to the shape of the female member 24, the groove 26*a* on the top side of the male member 22 is preferably recessed laterally inward farther than the groove 26*b* on the bottom side of the male member 22. The top groove 26*a* may also be recessed inward transversely between the top side 16 and the bottom side 18 of the plank 12 farther than the bottom groove 26*b*. Additionally, the top groove 26*a* is preferably defined by the upper protuberance 30*a* of the male member 22 and also by a top side protuberance 27 extending laterally outward from the top side 16 of the plank 12 on the lateral side 14 at which the male member 22 is disposed, as illustrated in FIG. 2B. The bottom groove 26*b* preferably does not have a corresponding bottom side protuberance extending laterally outward from the bottom side 18 of the plank 12. Thus, in this configuration of the profiled surfaces 20 of each plank 12, the upper protuberance 32*a* of the female member 24 fits into groove 26*a* between the upper protuberance 30*a* of the male member 22 and the top side protuberance 27. However, the lower protuberance 32*b* of the female member 24 fits into groove 26*b* against the lower protuberance 30*b*, but also forms part of the bottom side 18 of the plank 12 and fits flush with the bottom side 18 of an adjacent plank 12, as best seen in FIG. 2C. Thus, the upper protuberances 30*a* and 32*a* and corresponding grooves 28*a* and 26*a*, respectively, are generally larger than the lower protuberances 30*b* and 32*b* and corresponding grooves 28*b* and 26*b*, and also generally provide more extensive interlocking than the lower protuberances and grooves.

This configuration of the profiled surfaces 20 of each plank 12 may be preferred to facilitate assembly and disassembly of the table 10 by allowing the planks 12 to more easily be interlocked with each other and also separated from each other. This configuration may also enhance the stability of the interlocked planks 12 forming the tabletop when pressure is applied downward onto one or more planks 12 when the table 10 is being used. For instance, as shown in FIG. 2C, when an end plank 12*a* is rotated downward relative to an adjacent plank 12, the lower protuberance 32*b* of the female member 24 of the end plank 12*a* is pushed into the bottom groove 26*b* of the adjacent plank 12, and the upper protuberance 32*a* is pushed against the top side protuberance 27, which generally keeps the adjacent planks 12 interlocked and laterally aligned. Similarly, if adjacent plank 12 is rotated downward relative to end plank 12*a*, the upper protuberance 30*a* of the male member 22 of adjacent plank 12 is forced against the interior of the upper protuberance 32*a* of the female member 24 of the end plank 12*a*, which also keeps the adjacent planks 12 interlocked and laterally aligned. In a corresponding manner, rotating either plank 12 or, particularly, end plank 12*a* upward relative to the adjacent plank 12 allows the interlocking profiled surfaces 20 of the planks to separate with minimal application of rotational force so that the planks may be separated easily when disassembling the table 10. When rotating end plank 12*a* upward, the lower, smaller protuberance 32*b* of the female member 24 of the end plank 12*a* slides against and over the lower, smaller protuberance 30*b* of the male member 22 of the adjacent plank 12 to release the end plank 12*a* from the adjacent plank 12. Similarly, when assembling the table 10, planks 12 may be interlocked by placing a first plank 12 in a horizontal position, then inserting the upper protuberance 32*a* of the female member 24 of a second plank 12 into the top groove 26*a* of the first plank 12 at an angle, such as a 45-degree angle, and then rotating the second plank 12 downward to laterally interlock the two planks, as illustrated in FIG. 2C. When rotating the second plank 12 downward, the lower protuberance 32*b* of the female member 24 of the second plank 12 slides against and over the lower protuberance 30*b* of the male member 22 of the first plank 12 to interlock the first and second planks 12. The procedure for interlocking or separating adjacent planks 12 may optionally be done by rotating either adjacent plank so that the relative rotation between the planks 12 is the same.

The portable table 10 further comprises a leg assembly 40 to which the tabletop is removably secured by opposing clamps 70 that secure opposing end planks 12*a* of the tabletop in a fixed position relative to the leg assembly 40, as best seen in FIG. 5. The leg assembly 40 comprises a crossbeam 42 connected to legs 46, which are preferably pivotally connected to the crossbeam 42 and foldable against an underside of the crossbeam 42. As shown in FIGS. 3 and 4, the leg assembly 40 is preferably a collapsible sawhorse assembly having two opposing pairs of A-frame legs 46. FIG. 3 shows the leg assembly 40 expanded for use in supporting the tabletop, and FIG. 4 shows the leg assembly 40 with the legs 46 folded for transport or storage. As shown in FIGS. 1, 7, and 8, the table 10 preferably comprises two opposing leg assemblies 40 to provide stability for the tabletop.

The crossbeam 42 of each leg assembly 40 has two opposing ends 44, and a clamp 70 is disposed at each end 44, as best shown in FIGS. 3 and 5. Each of the opposing clamps 70 is configured to mate with the profiled surface 20 of one respective end plank 12*a* of the tabletop to fixedly secure the end plank 12*a* against the crossbeam 42. In a preferred embodiment, each clamp 70 comprises an adjustable clip 74 that is configured to mate with the profiled surface 20 of one respective plank 12*a* to fixedly secure the plank 12*a* against the crossbeam 42, as best shown in FIGS. 6A and 6B. In a preferred embodiment, the adjustable clip 74 is configured to mate with the bottom groove 28*b* of the female member 24 of an end plank 12*a*, as shown in FIG. 6A, or with the top groove 26*a* of the male member 22 of an opposing end plank 12*a*, as shown in FIG. 6B. Thus, the clamp 70 is compatible with either the male member 22 or the female member 24 of the profiled surface 20 of each plank 12, depending on which lateral side 14 of a plank 12 is being used to secure the plank 12 to the crossbeam 42, which depends on which side of the tabletop is being clamped down. Each clip 74 preferably has a hooked end 76 sized and shaped to fit within grooves 26*a* and 28*b* to fixedly secure the tabletop against the crossbeam 42. When mated to the profiled surface 20 of a plank 12, the clip 74 is locked in place to secure the plank 12 against the crossbeam 42 so that the plank 12 will not move relative to the crossbeam 42. The vertical position of each clip 74 is adjustable within a range that allows the clip 74 to be used with either the male member 22 or the female member 24 of any plank 12.

In a preferred embodiment, each clamp 70 is a toggle clamp configured to secure the adjustable clip 74 in a fixed position. The toggle clamp 70 has a handle 72 that may be moved to either lock down the clip 74 in a fixed position or to release the clip 74 so that it may be vertically adjusted. FIGS. 6A-6C illustrate the handle 72 in the locked-down position in which the clip 74 is secured in a fixed position, and FIGS. 6D and 6E illustrate the handle 72 in the released position in which the clip 74 may be freely moved up and down to adjust the vertical positioning of the clip 74. The clip 74 preferably has slots 78 to allow for vertical adjustment. As best seen in FIG. 6C, the clip 74 preferably has a center slot 78 and to two outside slots 78. The center slot 78 accommodates the handle 72 and allows the clip 74 to move vertically around the stationary handle 72. The outside slots 78 preferably each have a stationary pin 80 disposed within the slot 78 to maintain vertical alignment of the clip 74 and to limit the range of vertical adjustment. As best seen in FIGS. 4 and 6C, each end 44 of the crossbeam 42 preferably has an indentation 82 sized to receive the hooked end 76 of the clip 74 to allow the clip 74 to move downward sufficiently so that the end 76 of the clip 74 is either below or flush with the top surface 43 of the crossbeam 42, as shown in FIG. 6C, which may allow the leg assembly 40 to optionally be used as a conventional sawhorse for purposes other than use with the present table 10.

In a preferred embodiment, each leg assembly 40 preferably comprises two opposing pairs of A-frame legs 46, as shown in FIG. 3. Each leg 46 is preferably rotatable inwardly and outwardly about a pivot point 80 in a direction transverse to the crossbeam 42, as well as foldable against the underside of the crossbeam 42. As best seen in FIGS. 4 and 6C, each leg assembly 40 preferably comprises a bracket 60 to which the legs 46, the clamp 70, and the crossbeam 42 may all be attached. The bracket 60 is preferably angled at opposing ends to allow pivoting of different components in directions transverse to the crossbeam 42 and also parallel to the crossbeam 42. FIG. 4 illustrates the leg assembly 40 completely collapsed with each of the legs 46 pivoted transversely inward and folded under the crossbeam 42. The bracket 60 may be pivotally connected to the crossbeam 42 at opposing ends of the bracket 60 via pins 62, as best seen in FIGS. 4 and 6C, to allow the legs 46 to be folded under the crossbeam 42 by pivoting the bracket 60. In addition, the top end of each leg 46 may be pivotally connected to the bracket 60 via the same pins 80 used for vertical alignment and restriction of the clip 74 to allow pivoting of the legs 46 in a direction transverse to the crossbeam 42. As best seen in FIGS. 6A and 6B, each bracket 60 preferably includes two opposing stoppers 64 that limit the range of outward transverse pivoting of each leg 46 to a position of normal use, as shown in FIG. 3. In a preferred embodiment, each set of A-frame legs 46 includes a cross support arm 50 that may be used to lock the two legs 46 in a fixed rotational position relative to each other, as shown in FIG. 3. The support arm 50 may be connected to one leg 46 so that the support arm 50 may pivot about a pin 56. The support arm 50 may have a hooked end 54 at an opposite end of the arm that hooks onto a pin 58 on an opposing leg 46 to lock the legs in a fixed position relative to each other.

In a preferred embodiment, the length of each leg 46 is adjustable. As best seen in FIG. 3, each leg 46 may comprise an upper tube 46*a* and a telescoping lower leg portion 46*b*, which may be extended to lengthen each leg 46 or retracted to shorten each leg 46. The crossbeam 42 and legs 46 are preferably sized so that four legs 46 may be folded under the crossbeam 42 as shown in FIG. 4 when the lower leg portions 46*b* of each leg 46 are fully retracted. Each leg 46 preferably comprises a clip 48 configured to secure the lower leg portion 46*b* in a fixed position within the upper tube 46*a* to lock each leg 46 at a fixed length.

The present portable table 10 may be assembled from components that include a plurality of interlocking planks 12 and at least one leg assembly 40. In a preferred embodiment, the crossbeam 42 of the leg assembly 40 and the planks 12 are sized to assemble a table 10 having a span of six planks 12, including two end planks 12*a*, with each plank 12 arranged perpendicularly to the crossbeam 42. In a preferred embodiment, the portable table assembly may include two leg assemblies 40 and a plurality of planks 12 of two different lengths so that tables 10 of varying tabletop sizes may optionally be assembled. In one embodiment, each plank 12 may be eight inches wide and three feet long to produce a 4' by 3' table 10, a shown in FIG. 8. In another embodiment, each plank 12 may be eight inches wide and five feet long to produce a 4' by 5' table 10, a shown in FIG. 7. In yet another embodiment, as shown in FIG. 1, planks 12 that are three feet long and five feet long may be used in combination to produce a 4' by 8' table 10. In this embodiment, the planks 12 are staggered so that each five-foot plank 12 is abutting a three-foot plank 12. The five-foot planks 12 and three-foot planks 12 preferably form a simple butt joint where the planks are abutting, though securing or fastening devices may optionally be used to strengthen the joints. In this embodiment, a third leg assembly 40 may be optionally utilized near the center of the tabletop in the section of the table 10 at which all of the five-foot planks 12 overlap across the entire width of the tabletop. It should be understood that the dimensions of the planks 12 and leg assemblies 40 may be varied and still fall within the scope of the present disclosure.

To assemble the present table 10, the leg assemblies 40 are first set in place with the legs 46 set in position for normal use so that the legs 46 support the crossbeam 42 in an elevated position, as shown in FIG. 3. Preferably, two leg assemblies 40 are utilized and spaced apart from each other. The planks 12 are then positioned across a top side 43 of each crossbeam 42 of the leg assemblies 40 in a laterally interlocking arrangement so that the top sides 16 of the planks 12 collectively define a tabletop that includes two opposing end planks 12*a*, as best seen in FIG. 5. Next, the clamps 70 are used to secure each of the two end planks 12*a*, respectively, in a position in which the bottom side 18 of each end plank 12*a* is retained securely against the crossbeam 42, as best seen in FIGS. 6A and 6B. To clamp down the end planks 12*a*, a hooked distal end 76 of each clip 74 of each clamp 70 may preferably be positioned against the profiled surface 20 of one respective end plank 12*a* and locked in place to securely retain each end plank 12*a* against the crossbeam 42. The handle 72 of each clamp 70 may be used to secure each clip 74 in a fixed position to retain the end planks 12*a* in place. This may be repeated for both leg assemblies 40 to complete assembly of the table 10 so that all of the planks 12 are locked in a fixed and secure position.

To position the planks 12 in a laterally interlocking arrangement on the crossbeam 42, a first end plank 12*a* may first be positioned adjacent to one of the clamps 70, and then a second plank 12 may be interlocked with the first end plank 12*a*. This process may be repeated to sequentially interlock each plank 12 with a preceding plank 12 to form the tabletop. Preferably, the first end plank 12*a* is positioned with the female member 24 of the end plank 12*a* adjacent the clamp 70, as shown in FIG. 6A, so that the next plank 12 interlocks with the male member 22 of the end plank 12*a*. The next plank 12 may then be interlocked with the end plank 12*a* by inserting the upper protuberance 32*a* of the female member 24 of the second plank 12 into the top groove 26*a* of the end plank 12*a* at an angle and then rotating the second plank 12 downward to laterally interlock the two planks. When the second plank 12 is rotated downward, the male member 22 of the end plank 12*a* is simultaneously inserted into the female member 24 of the second plank 12, thereby interlocking the planks. The planks 12 may be sequentially interlocked in this manner to complete installation of the tabletop.

Once all of the planks 12 are interlocked, the opposing clamps 70 may be used to secure the two opposing end planks 12*a* against the crossbeam 42. Because all of the planks 12 are laterally interlocked, this also secures the middle planks 12 against the crossbeam 42. The first end plank 12*a* positioned in place may be retained by the adjacent clamp 70 either before or after sequentially interlocking the remaining planks 12.

Once the planks 12 are all interlocked and the end planks 12*a* are secured to the leg assemblies 40, the completed assembly may be used a table 10. When a user is finished using the portable table, the table 10 may be disassembled by first using the clamps 70 to release each of the end planks 12*a*, which releases the entire tabletop from the leg assemblies 40. The individual planks 12 may then be separated from each other, preferably by rotating one plank upward relative to an adjacent plank to release the plank from the adjacent plank. The legs of each leg assembly 40 may also be shortened and folded to minimize the size of the leg assemblies 40, as shown in FIG. 4. The individual planks 12 and leg assemblies 40 may then be stored or placed within a bag, case, or other type of container for transport or storage. Because the tabletop is formed from a plurality of separate planks 12, none of the individual components of the portable table 10 are bulky or difficult to handle.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A portable table, comprising:

a plurality of planks each having two opposing lateral sides, wherein each lateral side of each plank has a profiled surface shaped to interlock with the profiled surface of an adjacent plank so that adjacent planks are laterally interlocked; and a leg assembly comprising a crossbeam connected to legs, wherein the crossbeam has two opposing ends, wherein the leg assembly comprises a clamp disposed at each respective end of the crossbeam, wherein each clamp is configured to mate with the profiled surface of one respective plank to fixedly secure the plank against the crossbeam.

2. The portable table of claim 1, wherein the profiled surface of one lateral side of each plank defines a male member, and the profiled surface of the opposing lateral side of each plank defines a female member, wherein the male and female members are sized and shaped to interlock with each other.

3. The portable table of claim 2, wherein each clamp comprises an adjustable clip configured to mate with a first groove on a top side of the male member or with a second groove on a bottom side of the female member.

4. The portable table of claim 1, wherein the legs of the leg assembly are pivotally connected to the crossbeam and foldable against an underside of the crossbeam.

5. The portable table of claim 1, wherein the leg assembly is a collapsible sawhorse assembly having two opposing pairs of A-frame legs.

6. The portable table of claim 1, wherein each clamp comprises an adjustable clip configured to mate with the profiled surface of one respective plank to fixedly secure the plank against the crossbeam.

7. The portable table of claim 6, wherein each clamp is a toggle clamp configured to secure the adjustable clip in a fixed position.

8. A portable table comprising:

a plurality of laterally interlocked planks each having a top side and a bottom side, wherein the top sides of the planks collectively define a tabletop, wherein the tabletop includes two opposing end planks; and a leg assembly comprising a plurality of legs connected to a crossbeam having two opposing ends, wherein the leg assembly comprises a clamp disposed at each respective end of the crossbeam, wherein each respective clamp secures one respective end plank in a position in which the bottom side of the end plank is retained securely against the crossbeam, wherein each plank has two opposing lateral sides, wherein each lateral side of each plank has a profiled surface shaped to interlock with the profiled surface of an adjacent plank, and wherein each clamp comprises an adjustable clip configured to mate with the profiled surface of one respective end plank to fixedly secure the end plank against the crossbeam.

9. The portable table of claim 8, wherein each clamp is a toggle clamp configured to secure the adjustable clip in a fixed position.

10. The portable table of claim 8, wherein each plank is arranged perpendicularly to the crossbeam.

11. The portable table of claim 8, wherein the profiled surface of one lateral side of each plank defines a male member, and the profiled surface of the opposing lateral side of each plank defines a female member, wherein the male and female members are sized and shaped to interlock with each other.

12. The portable table of claim 11, wherein each clamp comprises an adjustable clip configured to mate with a first groove on a top side of the male member or with a second groove on a bottom side of the female member.

13. The portable table of claim 8, wherein the legs of the leg assembly are pivotally connected to the crossbeam and foldable against an underside of the crossbeam.

14. The portable table of claim 8, wherein the leg assembly is a collapsible sawhorse assembly having two opposing pairs of A-frame legs.

15. A method of assembling a portable table, said method comprising the steps of:

providing a plurality of interlocking planks, wherein each plank has a top side, a bottom side, and two opposing lateral sides, wherein each lateral side of each plank has a profiled surface shaped to interlock with the profiled surface of an adjacent plank;

providing a leg assembly comprising a crossbeam supported by legs, wherein the crossbeam has two opposing ends, wherein the leg assembly comprises a clamp disposed at each respective end of the crossbeam, wherein each clamp is configured to mate with the profiled surface of one respective plank to fixedly secure the plank against the crossbeam;

positioning the planks on a top side of the crossbeam in a laterally interlocking arrangement so that the top sides of the planks collectively define a tabletop that includes two opposing end planks; and using the clamps to secure each respective end plank in a position in which the bottom side of each end plank is retained securely against the crossbeam.

16. The method of claim 15, wherein the legs of the leg assembly are pivotally connected to the crossbeam and foldable against an underside of the crossbeam, wherein the method further comprises the step of unfolding the legs to support the crossbeam in an elevated position.

17. The method of claim 15, wherein the profiled surface of one lateral side of each plank defines a male member, and the profiled surface of the opposing lateral side of each plank defines a female member, wherein the male and female members are sized and shaped to interlock with each other, wherein the step of positioning the planks in a laterally interlocking arrangement comprises inserting the male member of one respective plank into the female member of one respective adjacent plank.

18. The method of claim 15, wherein each clamp is a toggle clamp comprising an adjustable clip configured to mate with the profiled surface of one respective end plank to fixedly secure the end plank against the crossbeam, wherein the step of using the clamps to secure each respective end plank comprises positioning a distal end of each clip against the profiled surface of one respective end plank to securely retain each end plank against the crossbeam and then using each clamp to secure each clip in a fixed position.

* * * * *